US006304213B1

(12) United States Patent
Erceg et al.

(10) Patent No.: US 6,304,213 B1
(45) Date of Patent: Oct. 16, 2001

(54) METHOD AND SYSTEM FOR DETERMINING GAIN REDUCTIONS DUE TO SCATTER ON WIRELESS PATHS WITH DIRECTIONAL ANTENNAS

(75) Inventors: Vinko Erceg, Ocean Grove; Lawrence Joel Greenstein, Edison, both of NJ (US)

(73) Assignee: AT&T Corporation, New York, NY (US)

( * ) Notice: Subject to any disclaimer, the term of this patent is extended or adjusted under 35 U.S.C. 154(b) by 0 days.

(21) Appl. No.: 09/480,992

(22) Filed: Jan. 11, 2000

(51) Int. Cl.[7] ..... H01Q 3/00
(52) U.S. Cl. ..... 342/359
(58) Field of Search ..... 342/359

(56) References Cited

U.S. PATENT DOCUMENTS 5,739,788 * 4/1998 Dybdal et al. ..... 342/359

* cited by examiner

*Primary Examiner*—Theodore M. Blum
(74) *Attorney, Agent, or Firm*—Oliff & Berridge, PLC.

(57) ABSTRACT

A system and method for statistically modeling the operation of a directional terminal antenna in a wireless link. When using a directional terminal antenna, received power may be enhanced by as much as the antenna gain. In local scattering, however, the enhancement will be smaller. The system and method model this decrement, known as the gain reduction factor, Δ, for fixed suburban paths, based on angle-of-arrival measurements. The system and method also provide the capability to statistically model the transmission performance of a directional terminal antenna in a wireless link while analyzing influences of antenna height, antenna beamwidth, distance and season.

9 Claims, 4 Drawing Sheets

METHOD AND SYSTEM FOR DETERMINING GAIN REDUCTIONS DUE TO SCATTER ON WIRELESS PATHS WITH DIRECTIONAL ANTENNAS

BACKGROUND OF THE INVENTION

1. Field of Invention

The present invention is related to determination of transmission quality from directional antennas.

2. Description of Related Art

In fixed wireless systems, range and capacity can be maximized by using directional terminal antennas, in contrast to the omni-directional antennas used in mobile wireless systems. The received power can be higher than that for an omni-directional antenna by as much as the azimuthal gain ($G_0$, in dB) of the antenna, but only if the arriving rays lie in an angular range much narrower than the main-lobe. If they do not, some arriving rays will be weighted by the antenna side-lobes and the increase in received power will be less than $G_0$. This decrement is referred to as the gain reduction factor $\Delta$, in dB. Determining this gain reduction factor in suburban environments can be complicated and results are only marginally accurate.

SUMMARY OF THE INVENTION

The exemplary embodiment of the invention provides a system and method for statistically modeling the operation of a directional terminal antenna in a wireless link. Although it is conventionally understood that, theoretically, received power may be enhanced by as much as the antenna gain when using a directional terminal antenna, the practical enhancement will be smaller due to local scattering. The system and method statistically model the gain reduction factor $\Delta$ experienced using a directional antenna in a wireless link. The system and method statistically model the gain reduction factor, $\Delta$, for fixed suburban paths, based on angle-of-arrival measurements. The system and method also provide the capability to statistically model the transmission performance of a directional terminal antenna in a wireless link while analyzing influences of antenna height, antenna beamwidth, distance and season.

BRIEF DESCRIPTION OF THE DRAWINGS

The benefits of the present invention will be readily appreciated and understood from consideration of the following detailed description of the exemplary embodiment of this invention, when taken with the accompanying drawings, in which.

DETAILED DESCRIPTION OF PREFERRED EMBODIMENTS

In fixed wireless systems, range and capacity can be maximized by using directional terminal antennas, in contrast to the omni-directional antennas used in mobile wireless systems. The received power can be higher than that for an omni-directional antenna by as much as the azimuthal gain ($G_0$, in dB) of the antenna, but only if the arriving rays lie in an angular range much narrower than the main-lobe. If they do not, some arriving rays will be weighted by the antenna side-lobes and the increase in received power will be less than $G_0$. This decrement is referred to as the gain reduction factor $\Delta$, in dB. The gain reduction factor $\Delta$ is variable from one user terminal location to another, even within the same cell, because it is affected by the locations and sizes of the scatterers near the user terminal.

The system and method according to the exemplary embodiments of the invention provide a statistical modeling mechanism for quantifying $\Delta$. This mechanism preferably has been used for modeling transmission capability in suburban environments at 1.9 GHz. Statistical modeling included determining the probability distribution of $\Delta$ over user locations in a cell, for various combinations of antenna height and season.

Figure 1:
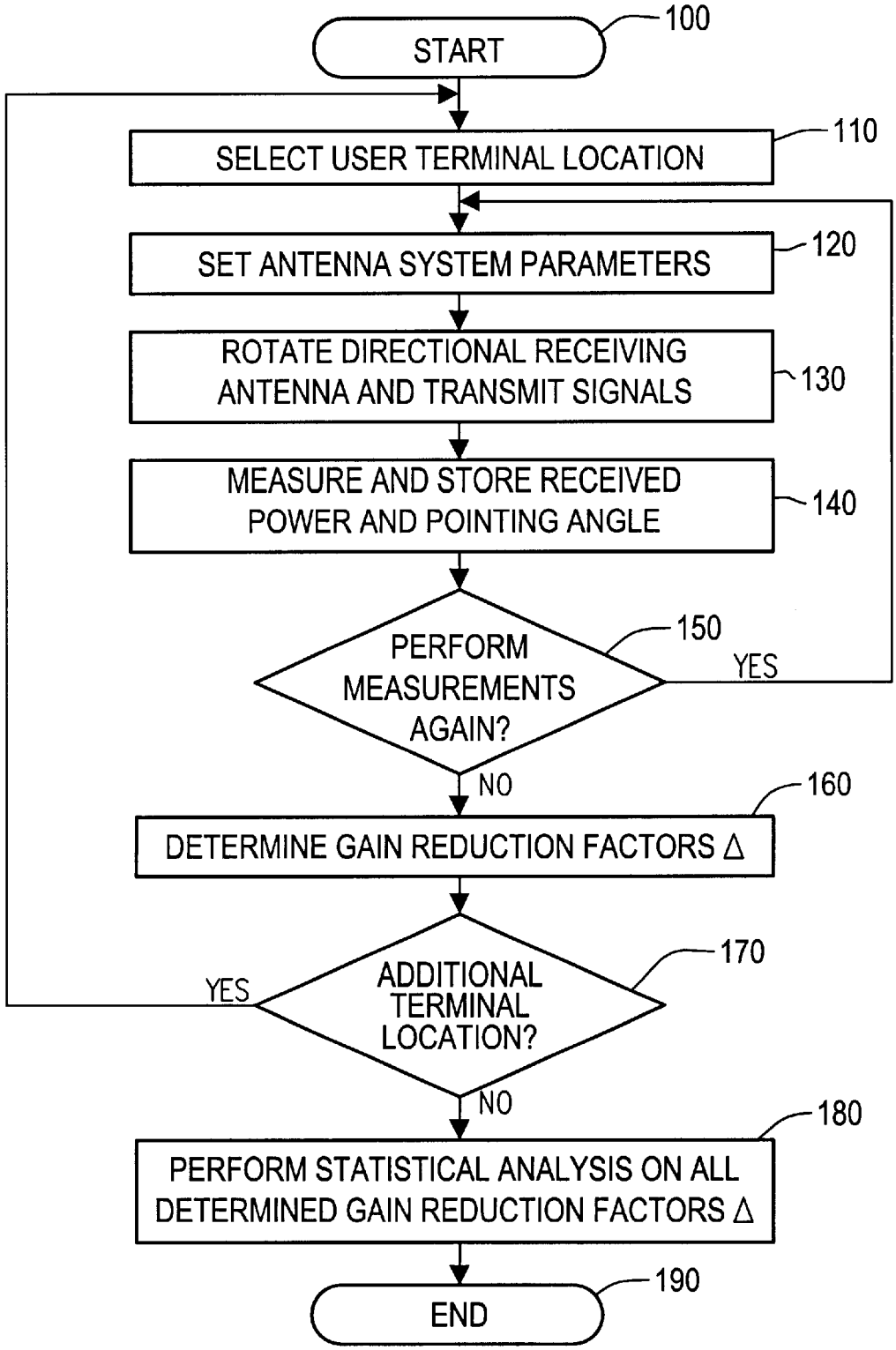
FIG. 1 illustrates a method of statistically modeling the operation of a directional terminal antenna in a wireless link in accordance with the exemplary embodiment of the invention.

The gain reduction factor for a given terminal depends on the angle-of-arrival distribution, $s(\theta)$, where $\theta$ is azimuth angle measured from the base-to-terminal direction and $s(\theta)$ is the received power density with respect to $\theta$. FIG. 1 illustrates a method for statistically modeling the gain reduction factor in accordance with the exemplary embodiment of the invention. As shown in FIG. 1, the method begins in step 100 and control proceeds to step 110, wherein a user terminal location is selected within a cell coverage area. Control then proceeds to step 120, wherein parameters such as antenna height are chosen. Control then proceeds to step 130, wherein the direcitonal receiving antenna is rotated and transmission signals are sent to the directional receive antenna of the measurement system. Control then proceeds to step 140. In step 140, the received power density $s(\theta)$ is measured by periodic sampling while the narrowbeam antenna is slowly rotated over $2\pi$ radians and periodically recording pointing angle and received power. (Alternative embodiments of the sampling process are possible, e.g., electronically controlled phased array antennas, which would have the same functional results.) Also in step 140 the measurements are stored. (During step 140, in the experiment, explained below, the transmission signal was maintained uniform in power over a 10-MHz bandwidth centered near 1.9 GHz.) Control then proceeds to step 150, in which it is determined whether the steps 120–140 are to be performed again based on different suburban and environmental conditions. If so, control returns to step 120. If not, control proceeds to step 160, in which the data gathered and stored in step 140, are analyzed to determine the gain reduction factors $\Delta$.

A determination in step 150 to gather additional measurements may be based on dynamic conditions in the suburban environment. For example, if a period of time has passed such that the transmission signal path has changed, it may be useful to again measure the received power density and associated measurements. Such may be the case when day has progressed to night, or clear air has turned to rain or snow, or a light wind turns to heavy wind, etc. Therefore, it may be beneficial to model the antenna performance as a function of time-of-day, weather conditions, etc.

Alternatively, it may be beneficial to compute $\Delta$ for multiple antenna heights to determine the most optimum height. Whatever the motive for making additional measurements at the same location, control proceeds to step 120 and new parameters are chosen, followed by repetition of the measurement procedure in steps 130 and 140. If no additional measurements are to be made at the given location, control proceeds to step 160, where Δ is computed for each measurement at that location.

In step 160, gain reduction factors are calculated for every complete measurement made at the user terminal location. The azimuthal gain pattern of a terminal antenna is denoted as $g_a(\theta)$, where θ=0 corresponds to the boresight (i.e., the dB gain, $G_o$, is 10 log $g_a(0)$). Also, the maximum of s(θ) for a particular transmission antenna site at some angle θ=α, with α varying with a location of a receiving antenna. In a properly aligned link, the transmission antenna mainlobe is pointed in the direction θ=α. The gain reduction factor may then be modeled as:

$$\delta = g_a(0)\int_0^{2\pi} s(\theta) \Big/ \int_0^{2\pi} g_a(\theta-\alpha)s(\theta)d\theta \tag{1}$$

The dB value of δ is Δ, as defined earlier. δ can be as low as 1 (Δ=0 dB), which occurs when s(θ) is an impulse at θ=α. δ may be as high as $g_a(0)$ (Δ=$G_0$ dB), which occurs when s(θ) is uniform over all θ. Step 140 characterizes the statistical variation of Δ, over the suburban terrain, between these two extremes.

Each estimate of s(θ) is imperfect because the azimuthal pattern $g_m(\theta)$ of the measurement antenna is not an ideal pencil beam. The resulting estimate is $$s'(\theta) = \frac{1}{2\pi}\int_0^{2\pi} g_m(\gamma-\theta)s(\gamma)d\gamma \tag{2}$$

The outcome of (1) with s(θ) replaced by s' (θ) is denoted by δ'. This is the gain reduction factor obtained using the imperfect estimate of s(θ). The dB error in the calculation is defined as E=10 log ($\delta^1/\delta$). As a result, a first-order correction is made by noting two extreme cases:

(i) When s(θ) is an impulse, A has its smallest possible value (0 dB), and E has its largest possible value, namely, $$Emax = 10\ \log\left[\left(g_a(0)\int_0^{2\pi} g_m(\theta)d(\theta)\right) \Big/ \int_0^{2\pi} g_a(\theta)g_m(\theta)d(\theta)\right. \tag{3}$$

(ii) When s(θ) is uniform over all θ, Δ has its largest possible value ($G_0$ dB), and E has its smallest possible value, namely, 0 dB. Between these end points (at Δ=0 and Δ=$G_0$, an approximation of E vs. Δ may be made by a linear curve, i.e., E ≐ Emax−(Emax/$G_0$) Δ. Noting that E=Δ'−Δ, a simple correction to the imperfect estimate Δ' may be calculated as:

$$\Delta = \frac{\Delta' - Emax}{G_0 - Emax}G_0 \tag{4}$$

This correction formula is accurate so long as Emax, (3) is reasonably small, e.g., below 2 dB. This condition is met so long as the beamwidth of $g_a(0)$ is not less than that of $g_m(\theta)$.

Subsequent to determining the gain reduction factors in step 160, control proceeds to step 170 in which it is determined whether to select a new user terminal location within the cell. If so, control returns to step 110, wherein a new receiving location is selected and method steps 120–170 are performed. If not, control proceeds to step 180, in which all the values of Δ computed for all the measured locations are subjected to statistical analysis. Control then proceeds to step 190, in which the method ends.

Figure 2:
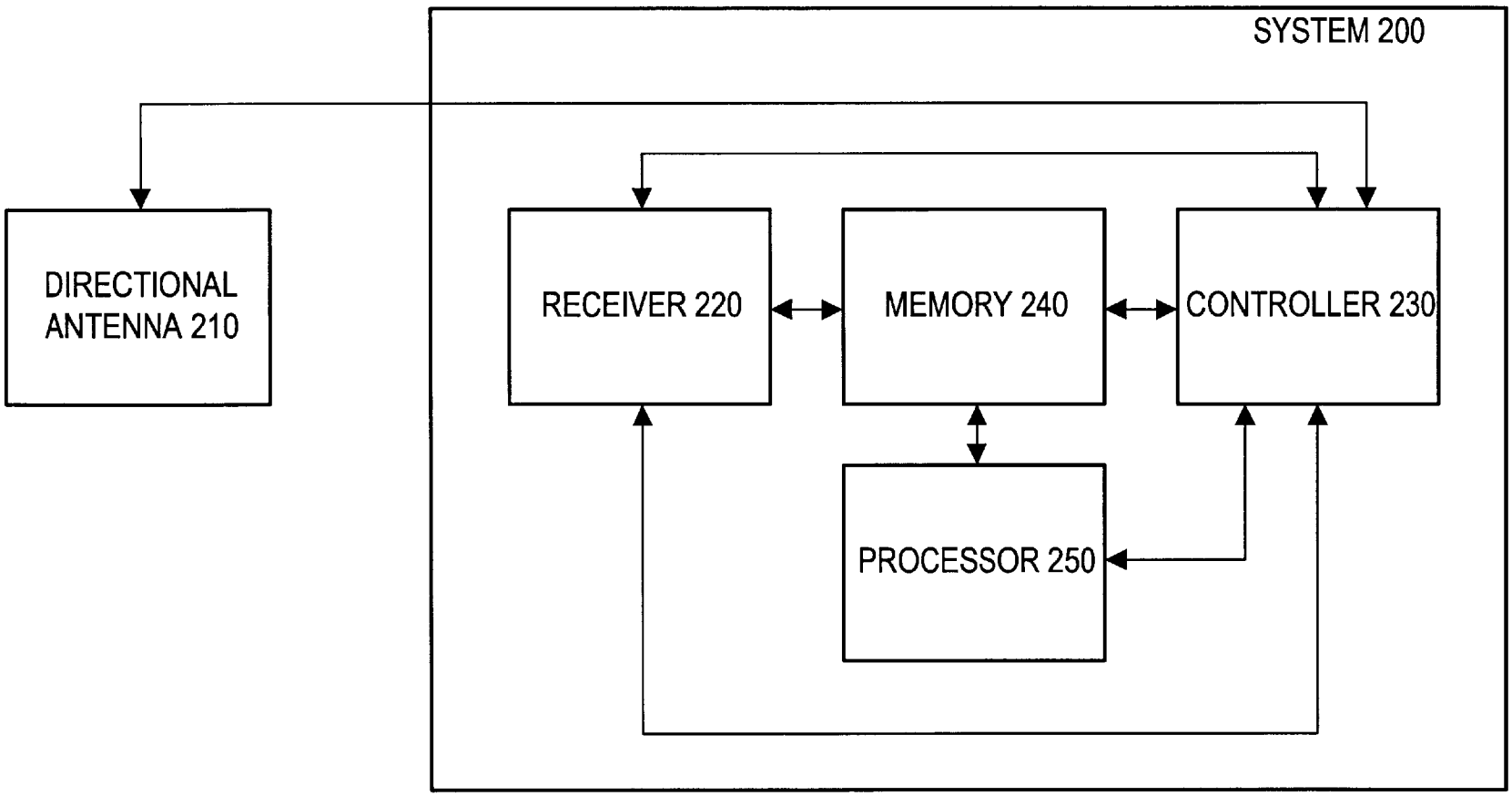
FIG. 2 illustrates a system for use to statistically model the operation of a directional terminal antenna in a wireless link in accordance with the exemplary embodiment of the invention.

FIG. 2 illustrates a system for use to statistically model the operation of a directional terminal antenna in a wireless link in accordance with the exemplary embodiment of the invention. The system 200 includes a receiver 220 that receives output signals from a directional receiving antenna 210, a controller 230 coupled to both the receiver 220 and the directional antenna, a memory 240 coupled to the controller 230 and the receiver 220 and a calculation processor 250 coupled to the controller 230 and the memory 240. The controller 230 controls both the attributes of the directional antenna and measurements performed using the receiver 220. The controller 230 controls the pointing angle of the directional antenna beam pattern and may also control other physical characteristics of the directional antenna, e.g., height. The controller 230 is coupled to the memory 240 and the receiver 220 so that the receiver 220 stores measurement data in the memory 240. The controller 230 also controls operation of the calculation processor 250 to perform operations to determine the gain reduction factor Δ, and also its statistical distribution over a set of measurement sites (potential user terminal locations).

It should be appreciated that the controller 230, memory 240 and calculation processor 250 may each be implemented in a general purpose computer. Additionally, the controller 230 may be coupled to the directional antenna using a wired or wireless link to control transmission by the directional antenna.

The inventors of the present invention gathered experimental data during the development of the invention. The experimental data was gathered using a central bandwidth of 9 MHz out of 10 MHz measured. In such experimental data, a full rotation of the directional antenna took approximately 90 seconds, with data recordings every 0.4 seconds. Thus, successive s(θ) samples were spaced apart by 1.6 degrees. The experiment was conducted for three transmit sites in suburban north and central New Jersey. For each site, thirty-three or more fixed terminal locations were measured using a receiving van with a variable-height antenna mast. Measurements were made at both 3 meter and 10 meter antenna heights. The receiving van was located at distances ranging from 0.5 kiometers (km) to 9 km from the variable-height antenna mast. Measurements were made in summer (trees in full bloom) and, for over half of them, the measurements were repeated in winter (trees bare).

The transmit sites were in Holmdel, Clark and Whippany, all residential communities. Each site overlooked a terrain of rolling hills, moderate-to-heavy tree densities and dwellings of 1–2 stories. The Holmdel data was collected using a dish antenna with a half-power beamwidth, β, of 17°. The Clark and Whippany data were collected using a panel antenna, with β=30°.

The statistical populations of Δ for Clark and Whippany were so similar that the inventors pooled them. The populations for Holmdel were consistently lower than for Clark and Whippany, probably because the transmit site overlooked close-in hills that produced strong shadowing. The inventors speculated that this limited the amount of scattering at the measurements sites, thus yielding smaller gain reductions. The modeling was based on the pooled data populations of the Clark and Whippany sites since they were more representative of well-chosen cell sites.

Figure 3:
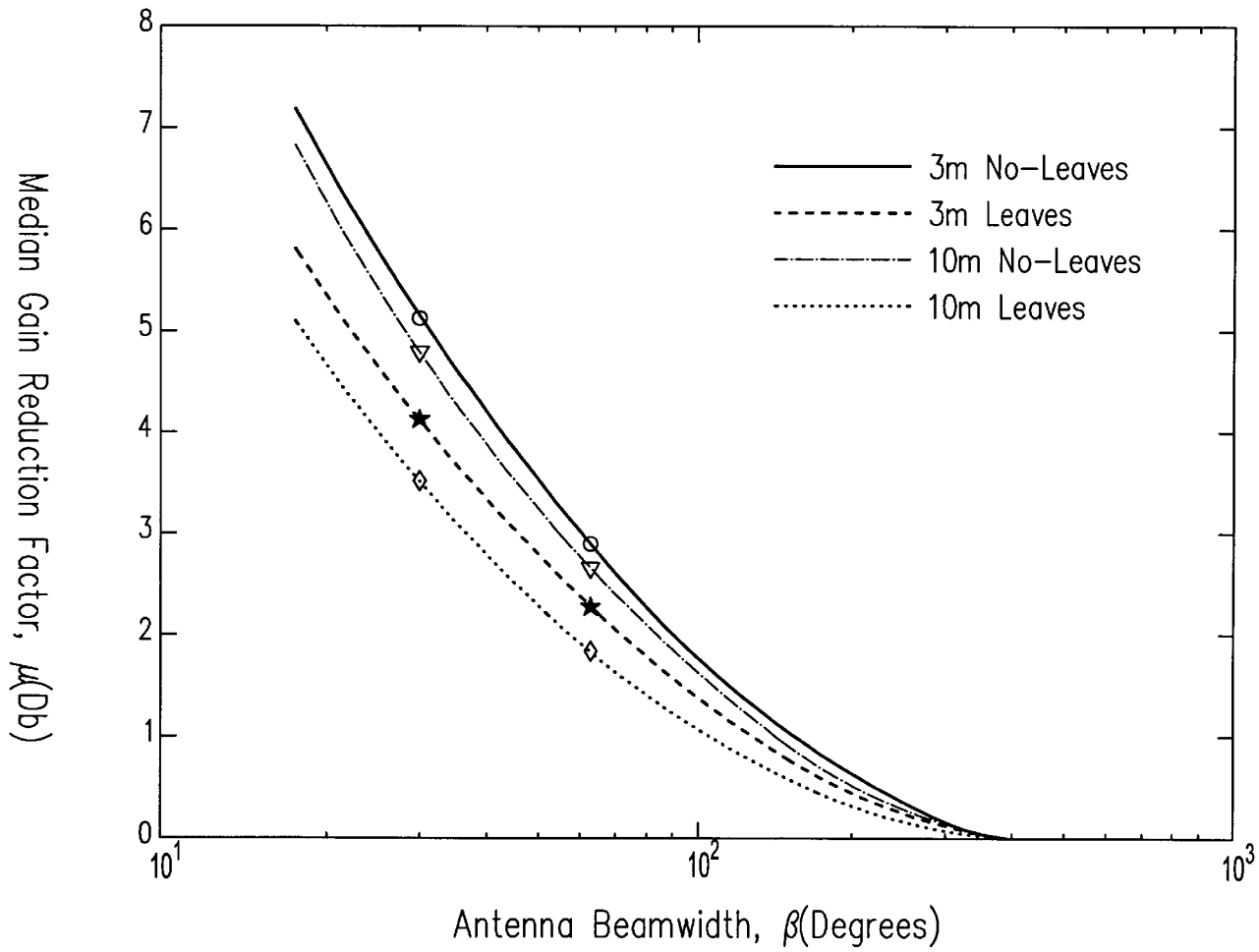
FIG. 3 shows experimental results for the median of $\Delta$ ($\mu$ in dB) vs. the bandwidth ($\beta$ in degrees) of a user terminal antenna.

FIG. 3 shows results for $\mu$ vs. β. It is asserted here that, for β=360°, the gain reduction is 0 dB with no spread, regardless of s(θ). This assertion is substantiated by equation (1). It should be seen that, for each season and h, a simple parabola fits the results for β=30°, 65° and 360°. The results for Holmdel (not shown) affirm that the extrapolation of such curves to $\beta=17°$ agree with calculations at that beamwidth as well. Thus, the parabolic fits may be extended to 17° in FIG. 3.

Figure 4:
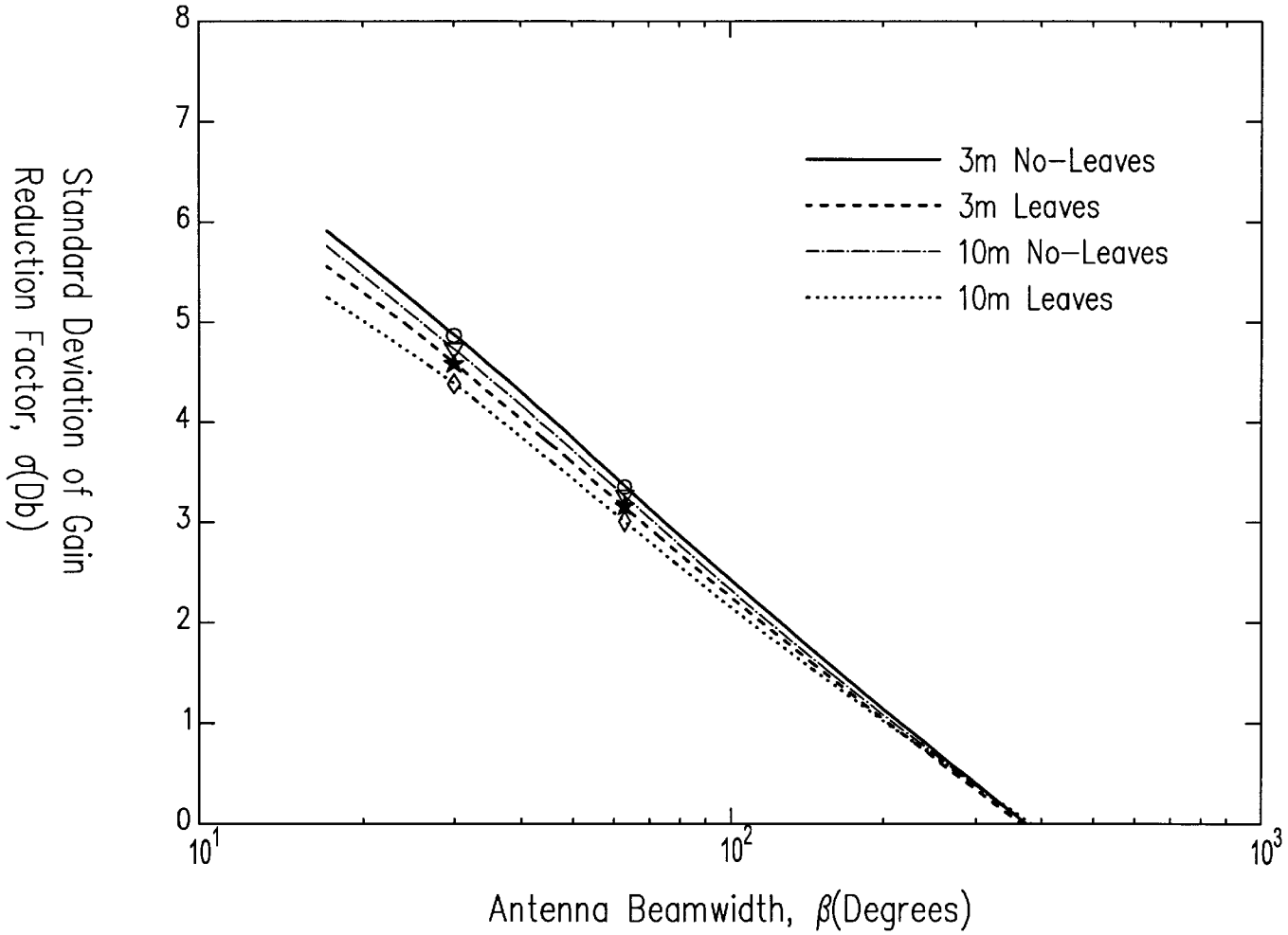
FIG. 4 shows experimental results for the standard deviation of $\Delta$ ($\sigma$ in dB) vs. The bandwidth ($\beta$ in degrees).

FIG. 4 shows results for $\sigma$ vs. $\beta$. In this case, fitting by a straight line is sufficient. It should be understood from FIGS. 3 and 4 that both $\mu$ and $\sigma$ are slightly higher for h=3 m than for h=10 m, and moderately higher in winter than in summer.

Since the influence of h is slight, the results for 3 m and 10 m were averaged leading to the following compact model for $\mu$ and $\sigma$:

$$\mu=-(0.53+0.11I)\ln(\beta/360)+(0.50+0.04I)(\ln(\beta/360))^2$$

$$\sigma=-(0.93+0.02I)\ln(\beta/360) \quad (5)$$

Where $\beta \geqq 17°$; $3\ m \leqq h \leqq 10\ m$; and I=+1 in winter and−1 in summer.

In fixed wireless channels with scattering, using a directional antenna offers less gain than in an ideal line-of-sight channel. The inventors modeled this gain reduction at 1.9 GHz for suburban environments with rolling hills and moderate-to-heavy tree densities. The dB gain reduction was approximately Gaussian over the terrain, with a mean and standard deviation that decrease smoothly with decreasing antenna beamwidth. These parameters were higher in winter than in summer, increased slightly with antenna height, and showed little dependence on distance.

For each transmit site, and each combination of season, height (h) and beamwidth ($\beta$), the inventors obtained a cumulative distribution function (CDF) of $\Delta$ over all downlink locations, with $\Delta$ computed as described above. Nearly every CDF was found to be close to Gaussian, with the median ($\mu$) and standard deviation ($\sigma$) being functions of season, h and $\beta$, but not of distance.

While this invention has been described in conjunction with the specific embodiments outlines above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of the invention.

What is claimed is:

1. A method for statistically modeling the operation of a directional antenna in a wireless link, the method comprising:

transmitting from a base antenna having a first configuration in relation to an environment;

rotating a narrowbeam, receiving antenna over $2\pi$ radians and periodically measuring pointing angle and received power of transmission signals received from the directional antenna; and determining a gain reduction factor $\Delta$ corresponding to operation of the directional antenna in the first configuration of the environment based on the periodically measured pointing angle and received power of the transmission signals, wherein the gain reduction factor $\Delta$ for the directional antenna depends on an angle-of-arrival distribution, $s(\theta)$, where $\theta$ is an azimuth angle and $s(\theta)$ is a received power density with respect to $\theta$ and, wherein the gain reduction factor $\Delta$ is modeled as:

$$\Delta = \frac{\Delta' - Emax}{G_o - Emax} G_o,$$

wherein $\Delta'$ is a gain reduction factor obtained from an imperfect estimate of the received power density calculated based on the angle-of-arrival distribution, $s(\theta)$, Emax is the maximum possible dB error of the gain reduction factor $\Delta$, and $G_o$ is dB gain of the directional antenna.

2. The method of claim 1, wherein the transmission signals are maintained uniform in power over a 10-MHz bandwidth centered near 1.9 GHz.

3. The method of claim 1 further comprising repeating the steps of transmitting, rotating, periodically measuring and determining for a second antenna configuration in relation to the environment.

4. The method of claim 1, wherein the gain reduction factor, $\Delta$, is determined for a fixed transmission path between the directional antenna and the receiving antenna based on angle-of-arrival measurements.

5. A system for use to statistically model operation of a directional terminal antenna in a wireless link, the system comprising:

a receiver that receives transmission signals from the directional antenna having a first configuration in relation to an environment;

a controller coupled to the receiver and the directional antenna, the controller controlling operation of the receiver and the directional antenna, the controller controlling the antenna to be rotated over $2\pi$ radians and to periodically measure pointing angle and received power of the transmission signals received from the directional antenna;

a memory coupled to the receiver and coupled to and controlled by the controller, the memory storing the pointing angle and received power of the transmission signals measured by the receiver under the control of the controller; and a calculation processor coupled to the memory and coupled to and controlled by the controller, the calculation processor determining a gain reduction factor $\Delta$ corresponding to operation of the directional antenna in the first configuration of the environment based on the periodically measured pointing angle and received power of the transmission signals, wherein the gain reduction factor $\Delta$ for the directional antenna depends on an angle-of-arrival distribution, $s(\theta)$, where $\theta$ is an azimuth angle and $s(\theta)$ is a received power density with respect to $\theta$, and the system of claim 7, wherein the gain reduction factor $\Delta$ is modeled as:

$$\Delta = \frac{\Delta' - Emax}{G_o - Emax} G_o,$$

wherein $\Delta'$ is a gain reduction factor obtained from an imperfect estimate of the received power density calculated based on the angle-of-arrival distribution, $s(\theta)$, Emax is the maximum possible dB error of $\Delta$, and $G_o$ is dB gain of the directional antenna.

6. The system of claim 5, wherein the transmission signals are maintained uniform in power over a 10-MHz bandwidth centered near 1.9 GHz.

7. The system of claim 5, wherein the controller controls the directional antenna, receiver, memory and calculation processor to model the operation of the directional antenna in a second antenna configuration in relation to the environment.

8. The system of claim 5, wherein the gain reduction factor, $\Delta$, is determined for a fixed transmission path between the directional antenna and the receiving antenna based on angle-of-arrival measurements.

9. The system of claim 5, wherein the calculation processor also computes a statistical distribution of a plurality of gain reduction factor $\Delta$ measurements.

* * * * *